US007309294B2

(12) United States Patent
Sasaki

(10) Patent No.: US 7,309,294 B2
(45) **Date of Patent: *Dec. 18, 2007**

(54) CLUB SHAFT

(75) Inventor: Hiroto Sasaki, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/152,239

(22) Filed: Jun. 15, 2005

(65) Prior Publication Data

US 2005/0282654 A1 Dec. 22, 2005

(30) Foreign Application Priority Data

Jun. 17, 2004 (JP) ..... 2004-179040

(51) Int. Cl.
*A63B 53/10* (2006.01)

(52) U.S. Cl. ..... 473/318; 473/321; 428/447; 528/26; 525/101; 525/446

(58) Field of Classification Search ..... 528/26; 428/447; 525/101, 446; 473/318, 321
See application file for complete search history.

(56) References Cited

U.S. PATENT DOCUMENTS 5,158,289 A * 10/1992 Okumoto et al. ..... 473/319
5,773,154 A * 6/1998 Takada ..... 428/458
7,115,050 B2 * 10/2006 Andre et al. ..... 473/378
2003/0083147 A1 5/2003 Sano

FOREIGN PATENT DOCUMENTS

JP 6-141740 A 5/1994
JP 2001-11376 * 1/2001
JP 2003-126306 A 5/2003

OTHER PUBLICATIONS

Machine generated English langauge translation of JP 2001-11376.*

* cited by examiner

*Primary Examiner*—Margaret G. Moore
(74) *Attorney, Agent, or Firm*—Sughrue Mion, Pllc.

(57) ABSTRACT

A club shaft composed of a club shaft body and a single- or multi-layered coating film covering said club shaft body, wherein said coating film includes a coating layer having good scratch or scuff resistance and high resilience. The club shaft keeps its good appearance owing to its self-healing ability even though it is damaged during carry in a caddie bag.

10 Claims, No Drawings

CLUB SHAFT

CROSS-REFERENCE TO RELATED APPLICATION

This non-provisional application claims priority under 35 U.S.C. §119(a) on Patent Application No. 2004-179040 filed in Japan on Jun. 17, 2004, the entire contents of which are hereby incorporated by reference.

BACKGROUND OF THE INVENTION

The present invention relates to a club shaft excelling in surface durability.

The recent trend in the field of sporting goods for fishing, golf, skiing, tennis, etc. is toward weight reduction, improved performance, and durable surface coating. Good durability of surface coating is important for sporting goods for outdoor use to retain a good appearance.

Coating materials that form durable coating film are disclosed in JP-A 2003-126306 and JP-A Hei 6-141740. The first one is a coating compound for golf clubs which is composed of 100 pbw (as solids) of acrylic resin and 1.0 to 10.0 pbw of polyethylene wax. This coating compound gives rise to a coating film which has not only good impact resistance (attributable to acrylic resin) but also good wear resistance and peel resistance. The second one is a coating compound based on acrylsilicone resin that gives rise to a coating film with good water repellency and scuff and soil resistance.

These conventional coating materials, however, are not entirely satisfactory. Even though they form a durable, scuff resistant coating film on sporting goods, the coating film is subject to scuff which propagates to deteriorate the appearance of sporting goods.

Golf clubs are liable to scuff each other while they are being carried in a caddie bag. Scuffs disfigure the appearance of club shafts during play. So, there has been a demand for durable club shafts which retain their good appearance.

SUMMARY OF THE INVENTION

The present invention was completed in view of the foregoing. It is an object of the present invention to provide a club shaft which keeps a good appearance even after it has been damaged during transportation of golf clubs in a caddie bag, because the club shaft has a coating film which repairs its temporary damage by itself with the lapse of time.

As the result of their extensive studies, the present inventors found that the above-mentioned object is achieved by a club shaft composed of a club shaft body and a single- or multi-layered coating film covering the club shaft body, wherein the coating film includes a layer having good scratch or scuff resistance and high resilience. This finding led to the present invention.

The first aspect of the present invention is directed to a club shaft composed of a club shaft body and a single- or multi-layered coating film covering the club shaft body, wherein the coating film includes a coating layer having good scratch or scuff resistance and high resilience.

The second aspect of the present invention is directed to the club shaft as defined above in which the coating layer having good scratch or scuff resistance and high resilience is one which is formed from any of a coating compound containing polydimethylsiloxane copolymer, polycaprolactone, and polysiloxane, a coating compound containing polydimethylsiloxane copolymer whose skeleton has polycaprolactone and polysiloxane introduced thereinto, a coating compound containing polydimethylsiloxane copolymer whose skeleton has polycaprolactone introduced thereinto and polysiloxane, and a coating compound containing polydimethylsiloxane copolymer whose skeleton has polysiloxane introduced thereinto and polycaprolactone.

The third aspect of the present invention is directed to the club shaft as defined in the first aspect which the coating layer having good scratch or scuff resistance and high resilience is formed after a deposited layer has been formed by ion plating on the surface of the club shaft body.

The fourth aspect of the present invention is directed to the club shaft as defined in the first aspect which is intended for golf, park golf, grand golf, and gate ball.

The club shaft according to the present invention keeps its good appearance even when golf clubs are carried together in a caddie bag.

DETAILED DESCRIPTION OF THE PREFERRED EMBODIMENTS

The invention will be described below in more detail with reference to its preferred embodiments.

The club shaft according to the present invention is composed of a club shaft body and a single- or multi-layered coating film covering the club shaft body. It is characterized in that the coating film includes a coating layer having good scratch or scuff resistance and high resilience.

The term "a coating layer having good scratch or scuff resistance and high resilience" as used in the present invention implies a coating layer which repairs its scuffs by itself with the lapse of time even when it is damaged slightly by scuffs or dents (hereinafter, such function described as self-healing ability). This function is ascribed to the good resilience of the coating film.

The coating film varies in resilience and the self-healing function relies on resilience. Resilience depends on the molecular structure of the block copolymer consisting of soft segments and hard segments. Hard segments form crystalline domains and soft segments form amorphous domains. Crystalline domains function as crosslinking sites (which prevent amorphous domains from plastic deformation). Thus, the coating film as a whole exhibits resilience, and the degree of resilience varies depending on the kind and composition of monomer units constituting the block copolymer and also on the arrangement of monomer units in the polymer chains.

There are no restrictions on the coating compound which forms the above-mentioned coating film having scratch or scuff resistance and high resilience. It may be selected from clear resins based on acrylate, urethane, polycarbonate, polystyrene, polyester, silicone, and fluoroplastics, in the form of homopolymer, copolymer, or blend. Its typical examples are listed below.

(1) One containing polydimethylsiloxane copolymer, polycaprolactone, and polysiloxane.
(2) One containing polydimethylsiloxane copolymer whose skeleton has polycaprolactone and polysiloxane introduced thereinto.
(3) One containing polydimethylsiloxane copolymer whose skeleton has polycaprolactone introduced thereinto and polysiloxane.
(4) One containing polydimethylsiloxane copolymer whose skeleton has polysiloxane introduced thereinto and polycaprolactone.

Each of the coating compounds (1) to (4) listed above contains polydimethylsiloxane copolymer (A), polycaprolactone (B), and polysiloxane (C). Each of polycaprolactone (B) and polysiloxane (C) may be present in the skeleton of dimethylpolysiloxane copolymer (A) or may be present separately in the coating compound.

The polydimethylsiloxane copolymer (A) mentioned above should preferably be a copolymer composed of polydimethylsiloxane segments and polymer chains formed from vinyl monomers. It may also be a block copolymer or a graft copolymer.

Examples of the vinyl monomer mentioned above include methyl acrylate, ethyl acrylate, n-butyl acrylate, isobutyl acrylate, octyl acrylate, cyclohexyl acrylate, tetrahydrofurfuryl acrylate, methyl methacrylate, ethyl methacrylate, n-butyl methacrylate, isobutyl methacrylate, 2-ethylhexyl methacrylate, stearyl methacrylate, lauryl methacrylate, methyl vinyl ether, ethyl vinyl ether, n-propyl vinyl ether, n-butyl vinyl ether, isobutyl vinyl ether, styrene, α-methylstyrene, acrylonitrile, methacrylonitrile, vinyl acetate, vinyl chloride, vinylidene chloride, vinyl fluoride, vinylidene fluoride, glycidyl acrylate, glycidyl methacrylate, acryl glycidyl ether, acrylic acid, methacrylic acid, itaconic acid, crotonic acid, maleic acid, maleic anhydride, citraconic acid, acrylamide, methacrylamide, N-methylol acrylamide, N,N-dimethylacrylamide, N,N-dimethylaminoethyl methacrylate, N,N-diethylaminoethyl methacrylate, and diacetoneacrylamide. Additional examples include vinyl monomers having OH group, such as 2-hydroxyethyl acrylate, 2-hydroxyethyl methacrylate, 2-hydroxypropyl acrylate, 2-hydroxypropyl methacrylate, and allyl alcohol. Another example is a reaction product of Cadura E with any of acrylic acid, methacrylic acid, itaconic acid, crotonic acid, and maleic acid.

Examples of the polycaprolactone (B) mentioned above include difunctional polycaprolactone, trifunctional polycaprolactone, and tetrafunctional polycaprolactone.

Examples of the polysiloxane (C) mentioned above include polymers of partial hydrolyzate of silane compound having hydrolyzable silyl groups or addition products obtained by adding the radical-polymerizable silane compound mentioned above to organosilica sol (which is a stable dispersion of silicon dioxide fine powder in an organic solvent). The silane compound is exemplified by tetramethoxysilane, tetraethoxysilane, methyltrimethoxysilane, methyltriethoxysilane, dimethyldimethoxysilane, dimethyldiethoxysilane, γ-glycidoxypropyltrimethoxysilane, γ-glycidoxypropyltriethoxysilane, γ-glycidoxypropylmethyldimethoxysilane, γ-glycidoxypropylmethyldiethoxysilane, γ-methacryloxypropyltrimethoxysilane, γ-methacryloxytriethoxysilane, γ-methacryloxypropylmethyldimethoxysilane, γ-methacryloxypropylmethyldiethoxysilane, γ-acryloxypropylmethyltrimethoxysilane, and γ-acryloxypropylmethyldimethoxysilane.

Incidentally, introduction of the polycaprolactone (B) and/or the polysiloxane (C) into the skeleton of the polydimethylsiloxane copolymer (A) may be accomplished by copolymerization for the polydimethylsiloxane copolymer in the presence of the polycaprolactone (B) and/or the polysiloxane (C).

The content of polydimethylsiloxane should preferably be 0.5 to 35 wt % in the polydimethylsiloxane copolymer (A) including one which has polycaprolactone (B) and/or polysiloxane (C) connected to the molecule thereof. The polydimethylsiloxane moiety protects the surface of the coating film from scuffs by its lubricating action to reduce the coefficient of friction.

The content of polycaprolactone (B) should preferably be 2 to 60 wt % in the solids of the coating material. Polycaprolactone (B) imparts high resilience to the coating film, thereby allowing the coating film to absorb external force applied thereto.

The content of polysiloxane (C) should preferably be 0.5 to 25 wt % in the solids of the coating material. Polysiloxane (C) imparts stain resistance, weather resistance, and heat resistance to the coating film and increases the surface hardness of the coating film.

The coating compound composed of the components (1) to (4) mentioned above may be cured by using a crosslinking agent which is capable of urethane-crosslinking and/or melamine-crosslinking the polydimethylsiloxane copolymer (A) including one which has polycaprolactone (B) and/or polysiloxane (C) connected to the skeleton thereof. Examples of the urethane-crosslinking agent include polyisocyanate and blocked-polyisocyanate, such as methylene-bis-4-cyclohexyl-isocyanate, trimethylolpropane adduct of tolylene diisocyanate, trimethylolpropane adduct of hexamethylene diisocyanate, trimethylolpropane adduct of isophoronediisocyanate, isocyanurate of tolylene diisocyanate, isocyanurate of hexamethylene diisocyanate, isocyanurate of isophorone diisocyanurate, and biuret of hexamethylene diisocyanate. Examples of the melamine cross-linking agent include alkoxymethylol melamine.

Any commercial product may be used as the coating compound that gives rise to a coating film having scratch or scuff resistance and high resilience. It is available from Natoko Paint Co., Ltd. under a trade name of "Self-healing clear", which is a special coating compound based on acrylic resin.

The coating compound used to form the coating film on the club shaft body may optionally be incorporated with any known paint additives listed below.

Leveling agent, such as Disparon L-1980-50 (from Kusumoto Chemicals, Ltd.)

UV light absorber, such as Tinuvin-P (from Ciba Specialty Chemicals K.K.) and ASL-23 (Shonan Kagaku)

Fluorescent brightening agent, such as Ubitex OB (from Ciba Specialty Chemicals K.K.), Hostalux KSN (from Hoechst Japan), and Hakkol PY-1800 (from Hakkol Chemical Co., Ltd.)

Slip agent, such as Disparon 1711 (from Kusumoto Chemicals, Ltd.) and Granol 450 (from Kyoeisha Chemical Co., Ltd.)

Light stabilizer, such as Adekastab LA-77 (from Asahi Denka Co., Ltd.) and Tinuvin 622LD (from Ciba Specialty Chemicals K.K.)

Curing catalyst, such as dibutyltin dilaurate, lead naphthenate, lead octylate, aluminum chelates, and tertiary amines.

Antifoaming agent, such as Disparon OX-710 (from Kusumoto Chemicals, Ltd.)

Thickening agent, such as Disparon AS-415 (from Kusumoto Chemicals, Ltd.)

Coloring pigment, such as titanium dioxide.

Plasticizer, such as dioctyl phthalate and dioctyl adipate.

It may also be incorporated with other resins such as polyester polyol and polyether polyol.

The coating compound may be used as an enamel coating compound after incorporation with pigments or as a clear coating compound without pigments.

The club shaft body (before coating) according to the present invention may be constructed from any material which will not impair the features of the present invention. Examples of such materials include titanium alloy, soft iron, stainless steel (and other steels), pure titanium, aluminum alloy, copper alloy, nickel alloy, tungsten alloy, amorphous alloy, carbon fiber-reinforced plastics (CFRP), and wood. They may be used alone or in combination with one another.

The club shaft body is not specifically restricted in its structure. That of CFRP may be produced by forming a laminate of prepreg (resin-impregnated sheet) around a mandrel (core) and then heat-curing the laminate. The prepreg is reinforcing fiber (in the form of roving, cloth, or mat) impregnated with a thermosetting resin. Examples of the reinforcing fiber include carbon fiber, glass fiber, metal fiber, aramid fiber, silicon carbide fiber, alumina fiber, and boron fiber. Examples of the thermosetting resin include epoxy resin, phenolic resin, and unsaturated polyester resin. The prepreg contains such auxiliaries as hardener, cure accelerator, filler, mold release, and pigment.

The prepreg may be prepared in the following manner. First, a strand is made from 1000 reinforcing fibers, each 4 to 10 μm in diameter. Next, 6 to 12 strands are arranged side by side to make a sheet. The sheet is layered with a thin sheet of thermosetting resin. The resulting laminate is passed through hot rolls, so that the resin impregnates into the reinforcing fibers. The content of the resin (including auxiliaries) in the prepreg (total weight) is usually 27 to 37 wt %. The thickness of the prepreg is usually 0.05 to 0.3 mm.

The club shaft body of CFRP is produced in the following manner. First, the above-mentioned prepreg is wound (in 4 to 12 layers) aslant (including 0 angle with respect to the axis of the mandrel) around a slightly tapered cylindrical mandrel (with a slope of 5 to 8 per thousand). The prepreg laminate on the mandrel is kept tight with a wrapping tape of polypropylene or the like and then cured in a heating furnace at an adequate temperature for an adequate period of time. After curing, wrapping tape and mandrel are removed. The resulting club shaft is finished by surface polishing to remove marks of wrapping tape.

Desirable materials for the club shaft body of CFRP include epoxy resin, phenolic resin, or unsaturated polyester resin reinforced with carbon fiber or boron fiber. An epoxy resin reinforced with carbon fiber is most desirable. It offers the advantage of being free from degradation by mold release agent and hence keeping its strength.

Prior to coating, the club shaft body should preferably undergo surface treatment for better coating adhesion. Surface treatment includes dry process, polishing, primer application, and pin-hole filling (which are explained below).

Dry treatment denotes ion plating, corona treatment, plasma processing, ultraviolet irradiation, electron beam irradiation and so on, which activates the surface of the shaft body.

Polishing denotes any process of polishing the shaft body with a wire brush or by sand-blasting.

Primer application is intended to form a primer layer which exhibits good adhesion to both the club shaft body and the coating layer thereon and which also facilitates detection of pinholes in the surface of the club shaft body. The primer layer may be formed from a liquid thermosetting polyester resin, which is cured after application.

Pin-hole filling is accomplished by applying a two-pack putty to pin-holes in the surface of the club shaft body.

The club shaft body according to the present invention should preferably be one which has a vapor deposition layer (formed by ion plating) on the surface of the club shaft body, and a self-healing coating layer formed on the vapor deposition layer. Ion plating is a process for forming a vapor deposition layer from a metal or a metal carbide, nitride, or boride.

Examples of the metal carbide, nitride, and boride include Ti compounds (such as TiC, TiCN, and TiB), Ta compounds (such as TaN, TaC, and TaB), Cr compounds (such as CrN, CrC, and CrB), Zr compounds (such as ZrN, ZrC, and ZrB), Nb compounds (such as NbN, NbC, and NbB), Hf compounds (such as HfN, HfC, and HfB), W compounds (such as WN, WC, and WB), Si compounds (such as SiN and SiC), Mo compounds (such as MoB), V compounds (such as VN, VC, and VB), and B compounds (such as BN, BC, MnB, and CoB). They may be used alone or in combination with one another.

It is to be noted that, the vapor deposition layer formed by ion plating may have the thickness no smaller than 0.001 μm, preferably no smaller than 0.01 μm, and no larger than 20 μm, preferably no larger than 10 μm.

According to the present invention, the coating film covering the club shaft body is composed of one layer or more than one layer, and it includes one self-healing layer. The coating layer having the self-healing function may be formed directly on the surface of the club shaft body or indirectly with an enamel coating layer or the like interposed between it and the surface of the club shaft body. The coating layer having the self-healing function exhibits good adhesion to the club shaft body if the club shaft body is coated with a deposited layer formed by ion plating. Generally, if a coating layer is formed after a deposited layer is formed on a club shaft body by ion plating, the coating layer tends to be peeled off easily. However, contrary to the conventional production, according to the present invention, the combination of the coating layer having the self-healing function and the deposited layer formed by ion plating exhibits good adhesion to the club shaft body.

The coating layer having the self-healing function may be formed by any method, such as brush coating, spray coating, and electrostatic coating, which is usually employed to coat the surface of club shafts.

The coating layer having the self-healing function may have a thickness no smaller than 1 μm, preferably no smaller than 10 μm, and no larger than 50 μm, preferably no larger than 30 μm.

The self-healing layer should have a thickness which accounts for no less than 5%, preferably no less than 10%, and more preferably no less than 20%, of the total thickness of single layer or multiple layers covering the club shaft body. The coating layer will be poor in scratch or scuff resistance if this requirement is not met.

Incidentally, the total thickness of the single layer or multiple layers covering the club shaft body is usually no smaller than 5 μm, preferably no smaller than 10 μm, and no larger than 100 μm, preferably no larger than 70 μm.

The club shaft according to the present invention is suitable for golf, park golf, grand golf, and gate ball. Its shape and weight should conform to their respective game rules.

The club shaft according to the present invention is coated with a coating layer which includes a layer having good scratch or scuff resistance and high resilience. Therefore, the coating layer applied to the outermost surface of the club shaft relieves external force (owing to its lubricating function) and restores its original shape (owing to its high resilience). Thus, the coating film is hardly subject to scuff and damage.

EXAMPLES

The invention will be described in more detail with reference to the following Examples, which are not intended to restrict the scope thereof.

Preparation of Coating Compound 1

Tetraethoxysilane (320 pbw) was mixed with ethanol (106 pbw), deionized water (21 pbw), and 1% hydrochloric acid (1 pbw). The resulting solution was allowed to stand at 85° C. for two hours and then gradually heated, during which ethanol was recovered. The solution was kept at 180° C. for 30 minutes and then cooled. Thus there was obtained viscous polysiloxane (1).

VPS-0501 (20 pbw) was mixed with toluene (50 pbw), methyl isobutyl ketone (50 pbw), methyl methacrylate (30 pbw), butyl methacrylate (26 pbw), 2-hydroxyethyl methacrylate (23 pbw), methacrylic acid (1 pbw), and 1-thioglycerin (0.5 pbw). VPS-0501 is a polymerization initiator containing polydimethylsiloxane units, available from Wako Pure Chemical Industries, Ltd. The resulting mixture was allowed to react at 80° C. for eight hours. Thus there was obtained polydimethylsiloxane block copolymer (1), which contains 50% solids and has a Gardner-Holtz viscosity of X.

Coating compound (1) was prepared by mixing together 75 pbw of the block copolymer (1), 10 pbw of the polysiloxane (1) mentioned above, 15 pbw of "Placcel 308", and 36 pbw of "Tekenate D-170N". "Placcel 308" is polycaprolactone having a molecular weight of 850 and an OH value of 195 KOH mg/g, available from Daicel Chemical Industries, Ltd. "Takenate D-170N" is HMDI isocyanurate as a crosslinking agent containing 100% solids and 20.7% NCO, available from Takeda Pharmaceutical Company Limited.

Preparation of Coating Compound 2

Coating compound (2) was prepared from 100 pbw of epoxy resin (from Cashew Co., Ltd.), 100 pbw of polyamide resin (from Cashew Co., Ltd.) as a curing agent, 0.005 pbw of dibutyltin dilaurate as a curing catalyst, and 250 pbw of 2:3:5 (by weight) mixed solvent of butyl acetate, MIBK, and propylene glycol monomethyl ether acetate (PMA).

Examples 1 and 2 and Comparative Examples 1 and 2

The surface of a golf club shaft body of CFRP was coated by spraying with each of the coating compounds (1) and (2) prepared as mentioned above. The coating layer was 20 μm thick. The thus obtained golf club shafts were tested for characteristic properties. The results are shown in Table 1.

TABLE 1

| | | | Example | | Comparative Example | |
|---|---|---|---|---|---|---|
| | | | 1 | 2 | 1 | 2 |
| Coating compound | | | (1) | (2) | (1) | (2) |
| Ion plating | | | yes | no | yes | no |
| Properties of club shaft | Brush test | Immediately after test | Δ | Δ | Δ | X |
| | | 10 seconds after test | ○ | ○ | Δ | X |
| | Pencil scuff test | | ○ | ○ | Δ | Δ |
| | Weather resistance | | ○ | ○ | ○ | ○ |
| | Adhesion test | | ○ | ○ | Δ | Δ |
| | Carry in a caddie bag | | ○ | ○ | Δ | X |

Ion Plating

The samples marked with "yes" have a 0.1-μm thick Cr layer formed by ion plating which was performed before the coating compound was applied to the surface of the golf club shaft of CFRP.

Brush Test

The sample club shaft was rubbed three times with a brass brush and then examined for scuffs immediately after rubbing and 10 seconds after rubbing. The results were rated in terms of decrease in gloss according to the following criterion.

○: no decrease in gloss
Δ: slight decrease in gloss
×: considerable decrease in gloss Pencil Scuff Test The surface of the sample club shaft is visually observed after scribing with a pencil (3H) and wiping. The results are rated according to the following criterion.

○: no scuffs
Δ: some scuffs

Weather Resistance

The sample club shafts were exposed for 200 hours in a sunshine weather-o-meter and then visually examined for the appearance of the coating film. The results were rated according to the following criterion.

○: No change in color

Adhesion

Adhesion was evaluated by cross-hatch test according to JIS K-5400. The results were rated according to the following criterion.

○: no peeling
Δ: some peeling

Carry in Caddie Bag

The coated club shaft was fixed to a club head. The resulting club was carried in a caddie bag for one round, and then visually examined for scuffs. The results were rated according to the following criterion.

○: no decrease in gloss
Δ: slight decrease in gloss
×: considerable decrease in gloss Japanese Patent Application No. 2004-179040 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A club shaft, comprising a club shaft body and a single- or multi-layered coating film covering said club shaft body, wherein said coating film includes a coating layer having good scratch or scuff resistance and high resilience, wherein the coating layer having good scratch or scuff resistance and high resilience is applied to the outermost surface of the club shaft body and is one which is formed from any of a coating compound containing polydimethylsiloxane copolymer, polycaprolactone, and polysiloxane, a coating compound containing polydimethylsiloxane copolymer whose main chain skeleton has polycaprolactone and polysiloxane introduced thereinto, a coating compound containing polydimethyisiloxane copolymer whose main chain skeleton has polycaprolactone introduced thereinto and polysiloxane, and a coating compound containing polydimetylsiloxane copolymer whose main chain skeleton has polysiloxane introduced thereinto and polycaprolactone, and wherein the coating layer has a thickness no smaller than 10 μm and no larger than 20 μm.

2. The club shaft of claim 1, which is intended for golf, park golf, grand golf, and gate ball.

3. The club shaft of claim 1, wherein the coating layer has a thickness which accounts for no less than 5% of the total thickness of single layer or multiple layers covering the club shaft body.

4. The club shaft of claim 1, wherein the coating layer has a thickness which accounts for no less than 10% of the total thickness of single layer or multiple layers covering the club shaft body.

5. The club shaft of claim 1, wherein the coating layer has a thickness which accounts for no less than 20% of the total thickness of single layer or multiple layers covering the club shaft body.

6. The club shaft of claim 1, wherein the total thickness of the single layer or multiple layers covering the club shaft body is no smaller than 10 μm and no larger than 100 μm.

7. The club shaft of claim 1, wherein the total thickness of the single layer or multiple layers covering the club shaft body is no smaller than 10 μm and no larger than 70 μm.

8. The club shaft of claim 1, wherein the polydimethylsiloxane copolymer comprises polydimethylsiloxane segments and polymer chains formed from vinyl monomers.

9. A club shaft, comprising a club shaft body and a single- or multi-layered coating film covering said club shaft body, wherein said coating film includes a coating layer having good scratch or scuff resistance and high resilience, wherein the coating layer having good scratch or scuff resistance and high resilience is applied to the outermost surface of the club shaft body and is one which is formed from any of a coating compound containing polydimethylsiloxane copolymer, polycaprotactone, and polysiloxane, a coating compound containing polydimethylsiloxane copolymer whose main chain skeleton has polycaprolactone and polysiloxane introduced thereinto, a coating compound containing polydimethylsiloxane copolymer whose main chain skeleton has polycaprolactone introduced thereinto and polysiloxane, and a coating compound containing polydimethylsiloxane copolymer whose main chain skeleton has polysiloxane introduced thereinto and polycaprolactone, wherein the coating layer having good scratch or scuff resistance and high resilience is formed after a deposited layer has been formed by ion plating on the outermost surface of the club shaft body, and wherein the coating layer has a thickness no smaller than 10 μm and no larger than 20 μm.

10. The club shaft of claim 9, wherein the polydimethylsiloxane copolymer comprises polydimethylsiloxane segments and polymer chains formed from vinyl monomers.

* * * * *